US006881491B2

(12) United States Patent
Jankosky et al.

(10) Patent No.: US 6,881,491 B2
(45) Date of Patent: Apr. 19, 2005

(54) PROTECTIVE FLUORIDE COATINGS FOR ALUMINUM ALLOY ARTICLES

(75) Inventors: Sally A. Jankosky, Lower Burrell, PA (US); Susanne M. Opalka, Glastonbury, CT (US); Paula L. Kolek, Tarentum, PA (US); Joseph P. Harenski, Export, PA (US); Roger W. Kaufold, Pittsburgh, PA (US); Larry F. Wieserman, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 38 days.

(21) Appl. No.: 10/439,988

(22) Filed: May 16, 2003

(65) Prior Publication Data

US 2004/0229071 A1 Nov. 18, 2004

(51) Int. Cl.[7] ..... B32B 15/04; B32B 15/20; C23C 22/73; C23C 22/78

(52) U.S. Cl. ..... 428/472.2; 428/469; 428/696; 427/327; 427/388.1; 148/275; 148/277; 148/283; 148/285

(58) Field of Search ..... 428/472.2, 469, 428/696; 148/275, 277, 283, 285; 427/388.1, 180, 327

(56) References Cited

U.S. PATENT DOCUMENTS

| | | | | |
|---|---|---|---|---|
| 2,024,751 A | | 12/1935 | Stroup | 75/58 |
| 2,092,033 A | | 9/1937 | Stroup | 148/13.1 |
| 2,092,034 A | | 9/1937 | Stroup | 148/13.1 |
| 2,379,467 A | | 7/1945 | Abbe | 148/21.1 |
| 2,380,202 A | | 7/1945 | Stroup | 148/21.3 |
| 2,885,313 A | | 5/1959 | Milliken | 148/6.27 |
| 2,885,315 A | | 5/1959 | Milliken | 148/13.1 |
| 2,885,316 A | | 5/1959 | Milliken | 148/13.1 |
| 2,969,590 A | | 1/1961 | Milliken | 29/488 |
| 3,087,213 A | | 4/1963 | Milliken | 22/192 |
| 3,655,461 A | * | 4/1972 | Miwa | 148/23 |
| 4,671,825 A | | 6/1987 | Ishii et al. | 148/6.15 |
| 5,051,278 A | * | 9/1991 | Paz-Pujalt | 427/108 |
| 5,584,946 A | * | 12/1996 | Karmaschek et al. | 148/247 |
| 5,753,056 A | | 5/1998 | Opalka et al. | 148/703 |
| 6,059,174 A | * | 5/2000 | Kojima et al. | 228/183 |
| 6,120,618 A | | 9/2000 | Opalka | 148/250 |
| 6,306,226 B1 | | 10/2001 | Iino et al. | 148/247 |
| 6,355,121 B1 | | 3/2002 | Opalka et al. | 148/703 |
| 6,461,451 B1 | * | 10/2002 | Harenski et al. | 148/275 |
| 6,669,897 B1 | * | 12/2003 | Harenski et al. | 266/274 |
| 6,753,094 B1 | * | 6/2004 | Wittebrood | 428/626 |

FOREIGN PATENT DOCUMENTS

WO WO 00/64626 * 11/2000

OTHER PUBLICATIONS

Metals Handbook, 9th ed., vol. 14, "Cleaning", pp. 248–249, 1988; vol. 5,"Chemical Cleaning", pp. 788–790, 1994.*

Stroup, P.T. Atmospheric Control in the Heat Treatment of Aluminum Products, Controlled Atmospheres, 1942, American Society for Metals, Cleveland, Ohio.

* cited by examiner

*Primary Examiner*—John J. Zimmerman
(74) *Attorney, Agent, or Firm*—Gary P. Topolosky; Daniel P. Cillo; Eckert Seamans Cherin & Mellott, LLC

(57) ABSTRACT

An aluminum alloy article is cleaned to remove oxides and organic matter from a coatable surface, coated with a composition comprising an organic resin and a fluorine compound, and then heated to an elevated temperature to decompose the organic resin and at least a portion of the fluorine compound. After heating the coated surface is left with a protective oxyfluoride film that prevents blistering and hydrogen pickup and promotes hydrogen degassing from the article.

19 Claims, 6 Drawing Sheets

PROTECTIVE FLUORIDE COATINGS FOR ALUMINUM ALLOY ARTICLES

FIELD OF THE INVENTION

The present invention relates to coatings for protecting aluminum alloy articles during thermal processing.

BACKGROUND OF THE INVENTION

Aluminum alloys, such as aluminum-magnesium alloys are commonly subjected to various heat treatments in their processing. Abbe, in U.S. Pat. No. 2,379,467, recognized in 1945 that such heat treatment can cause surface blistering. Abbe solved this problem by cleaning aluminum alloy forgings with lye and nitric acid solution, and then wetting them with a water solution of sodium fluorborate, and then drying the forgings before heat treatment. Even earlier, Stroup, in U.S. Pat. No. 2,092,033, recognized that there was a greater susceptibility to blistering where the atmosphere surrounding the aluminum contained constituents such as water vapor, ammonia or sulfur compounds and where the aluminum was alloyed with magnesium in combination with copper, nickel, silicon and/or zinc. Stroup found that most blistering occurred at temperatures over about 427° C. (801° F.)—above the usual range employed for annealing cold worked aluminum alloys. Stroup's solution to eliminate blistering was to provide a protective atmosphere containing vaporous fluorine-bearing compounds, based on the volume of the heating furnace. The fluorine constituent was added to the furnace atmosphere either by heating solid fluorine-containing salts in the furnace or by introducing vaporous fluoride such as hydrogen fluoride, boron fluoride, or low molecular weight or low carbon number fluorinated aliphatic hydrocarbons in gaseous form. In the former case, the solid materials may be deposited on the floor of the furnace or in some container and allowed to vaporize or decompose under the influence of heat. Certain fluorides, calcium fluoride, sodium fluoride and potassium fluoride, were not found to be effective, however. In U.S. Pat. No. 2,380,202 (Stroup) the beneficial effect of a fluorine-containing atmosphere was improved, for alloys containing at least 70% magnesium, by incorporating calcium or beryllium into the alloy and using an atmosphere of HF, $BF_3$, organic fluoride gases and dry carbon dioxide rather than air. Stroup, in U.S. Pat. No. 2,092,034 deliberately applied an artificial oxide coating to aluminum alloys before subjecting the alloy to thermal treatment, as a means to control high temperature blistering. These vapors could however cause corrosion problems in furnaces over a long period of time. In a subsequent article "Atmospheric Control In The Heat Treatment Of Aluminum Products", P. T. Stroup, *Controlled Atmospheres*, October 1991, pp. 207–220, American Society for Metals, Cleveland, Ohio, Stroup further discussed and illustrated blistering and voids in cross-sectional views caused by heating aluminum sheet in air containing as little as 0.0012% total sulfur.

U.S. Pat. No. 2,885,313 (Milliken) teaches thermal treatment of aluminum base alloys containing magnesium to prevent subsequent atmospheric and high-temperature oxidation and corrosion and to facilitate degassing of finished and semi-finished articles of such alloys. Milliken postulated that the oxidation was caused by the attack of water upon the surface, oxidizing the aluminum and releasing hydrogen. There, finished or semi-finished aluminum base alloy articles were coated with an "organic ammonium fluoroborate—carrier compound" an amine or amide compound with boron trifluoride (that is a reaction product with the boron trifluoride) which would yield boron trifluoride, $BF_3$, when heated for a time sufficient to cause substantial disappearance of the organic part of the organic ammonium fluoroborate compound, and provide a "protective film" on the alloy surface which film was substantially free of organic material. The Milliken organic ammonium fluoroborate-carrier compounds included aliphatic ammonium fluoroborates, di-n-butyl ammonium tetrafluoroborate; n-octadecyl-N,N,N, trimethyl tetrafluoroborate and di-n-amyl ammonium tetrafluoroborate. These organic ammonium fluoride compounds are applied generally as solutions in alcohol or water where the boron trifluoride content was from about 0.4 wt. % to preferably 2.6 wt. %. Then, as a separate heating step, degassing followed at from about 399° C. to 524° C. (750° F. to 975° F.) for from several hours to 20 days depending on the thickness of the article and rate of hydrogen diffusion in the particular alloy.

U.S. Pat. Nos. 2,885,315; 2,885,316; 2,969,590; 3,087,213; 6,120,618; 5,753,056; 5,985,059; and 6,355,121 B1 are additional, patents generally relating to this area. Iino et al., in U.S. Pat. No. 6,306,226 B1 also used a chemical etching process, while Ishii et al., in U.S. Pat. No. 4,671,825 formed a hydrophilic corrosion-resistant coating on aluminum alloy material. There an aqueous solution of dissolved water-soluble acrylic acid polymer, dispersed colloidal silica, hexavalent chromium compound, phosphoric acid, and fluorine compound were used.

The blistering and hydrogen degassing problems have never been completely solved. What is needed is a method that can apply a continuous film of protection and which will adhere to and cover corners, edges, and the bottom portion of aluminum articles during heat treatment. This is particularly important regarding aircraft components and the like.

SUMMARY OF THE INVENTION

It is one of the main objects of this invention to provide anti-sagging, adherent fluids with good edge coverage of aluminum alloy articles which coatings can dry at room temperature and can then be decomposed, that is pyrolyzed, oxidized or vaporized, to provide a continuous protective surface and to control blistering. It is another object of this invention to inhibit hydrogen pick-up during aluminum alloy heat treatment practices and to promote hydrogen degassing using protective coatings. The above need and objects are met by providing a method of protectively coating an aluminum alloy article having at least one coatable surface, comprising: (a) deoxidizing and cleaning the article by a caustic treatment and an acid treatment with a water rinse between and after the two treatments to remove organics and oxides, from the coatable surface of the article; (b) applying a polymeric coating comprising organic resin and fluoride containing compound directly to the surface of the article such that the coating will have from 50,000 to 20,000,000 fluorine atoms per 1 square nanometer (nm) of the object's surface area; and (c) heating the coated object from ambient temperature to about 400° C. to 650° C. (752° F. to 1202° F.) to decompose the organic resin, and decompose at least a portion of the fluoride compound, degas hydrogen within the article, and form a protective oxyfluoride film on the surface of the article. The treatments in step (a) will remove from the surface both organics and oxides over about 40 nm (1 nm=10 Å—angstrom units) thickness. The term "article" includes flat sheet, billet, machined, cast or forged parts, wrought or extruded objects made from aluminum alloys. Suitable aluminum alloys for practice of the invention preferably contain at least about 0.1 wt % magnesium. Such alloys include aluminum-copper alloys of the AA 2000 series; aluminum-manganese alloys of the AA 3000 series; aluminum-silicon alloys of the AA 4000 series; aluminum-magnesium alloys of the AA 5000 series; aluminum-silicon-magnesium alloys of the AA 6000 series; and aluminum-zinc alloys of the AA 7000 series. Heat-treatable alloys of the AA 2000, 6000, and 7000 series are especially preferred. The words "substrate" or "object" are sometimes used interchangeably with "article". By "oxy-fluoride" film is meant a film containing oxide and fluoride compounds of the alloying constituents in the aluminum article, primarily aluminum and magnesium. By "decomposing" the organic resin is meant destruction of the original polymeric structure where some solid residue may remain on the surface.

The caustic treatment can be with chemical bases having a pH>8, such as NaOH, KOH and the like, to remove oxides/organics not soluble in acid. The acid treatment can be with acids having a pH<6, such as $HNO_3$ and the like, to further remove almost all organics and oxides. These treatments also remove machining or casting lubricants. The polymeric coating will form a uniform coating with complete edge coverage as opposed to alcohol or aqueous coatings or coatings deposited from a mist or spray. Useful resins include the well known classes such as at least one of epoxy resins, polyurethane resins, polyolefins, polyacrylate resins and latex resins, such as those used in paints and varnishes. Useful viscosities vary upward from 1.5 cP (centipoise), preferably from 1.5 cP to 8,000,000 cP at 25° C. ($1.5\times10^{-2}$ dyne-sec/cm$^2$ to $8\times10^4$ dyne-sec/cm$^2$). More preferably, the viscosity is at least about 2 cP. The coating preferably also contains particles of fillers such as $TiO_2$, $SiO_2$, $Al_2O_3$, and the like capable of withstanding heating temperatures. The number of F atoms per square nanometer can be calculated from the F component content in the polymeric coating and the thickness of the coating on the substrate, also from the area of the coated substrate surface and the weight gained after coating.

The polymeric coating can in most cases cure at ambient temperatures as with paints and varnishes and the coated substrate stored until thermally processed. Water in the form of rain, snow, or dew will not wash off the cured paint. Upon heating the coated substrate, the resin will decompose to form gases such as $CO_2$ and $H_2O$. At over about 205° C. fluorides can decompose and hydrogen will be degassed from the interior of the substrate, with a resulting oxyfluoride film which inhibits hydrogen pickup even in moist atmosphere. Higher rates of hydrogen degassing occur at higher temperatures because the bulk diffusion rate of hydrogen in aluminum is higher. Useful fluorides include all organic or inorganic fluoride compounds that decompose above 200° C., to form active fluoride, for example sodium hexafluorosilicate, sodium hexafluoroaluminate (cryolite), potassium fluoride, calcium fluoride, sodium fluoride, potassium aluminum fluoride, magnesium fluoride, and their like including mixtures of such fluorides.

In this invention, the initial oxide layer is preferably reduced to a specific oxide thickness before applying the polymeric coating. Both organic and aqueous carriers may be used as the vehicle for the organic polymer. The invention is focused on climination of blister formation and hydrogen pick-up and promotion of hydrogen degassing during heat treatment. The invention is based on a fluoride coating on the surface area of substrate not the volume of the heating chamber, nor does the heating chamber require an atmosphere of $CO_2$ or fluorine containing gases. The method may be practiced in direct and indirect fired furnaces heated by any heat source. The invention minimizes the amount of active fluoride required since the amount is based solely on the surface area of the article and not the furnace volume. While the previous technology provided good results, the invention herein does not require dual heating steps and controls the amount of active fluoride applied in a precise manner by varying the viscosity of the polymeric coating and loading in the resin. Overall, this process provides lower material costs, reduced toxic emissions, less furnace corrosion and maintenance cost, as well as reduced worker risk.

BRIEF DESCRIPTION OF THE DRAWINGS

In a better understanding of the invention, reference may be made to the preferred non-limiting embodiments exemplary of the invention shown in the following drawings, in which.

DETAILED DESCRIPTION OF PREFERRED EMBODIMENTS

Aluminum alloy billets, castings, extrusions, forgings, sheet, plate, and the like objects are commonly subjected to heat treatment in furnaces having air atmospheres, products of combustion (POC), or atmospheres purged with $N_2$, Ar or $CO_2$. Such heat treatments are employed to increase for example strength, hardness, ductility, stability, corrosion resistance, or other properties and to promote the degassing of hydrogen from voids and solid solution. Temperatures in such heat treatments are commonly above 427° C. (801° F.) but below the melting point of the alloy. At low temperature, hydrogen gas is formed on the surface when aluminum reacts with water. At high temperatures atomic hydrogen forms and can diffuse into the aluminum. The rate of diffusion of hydrogen through solid aluminum is estimated at $2\times10^{-6}$ cm$^2$/sec at 205° C. (401° F.) and up to $1\times10^{-4}$ cm$^2$/sec or 0.60 inch/hr (1.52 cm/hr) at 455° C. (851° F.). At a temperature over 205° C. (401° F.) hydrogen reacts with the surface of aluminum and diffuses to grain boundaries, inclusions, or areas with tensile stress. If ingots are cold when placed in the furnace, water vapor can condense on the cold ingots and make the subsurface porosity (SSP) and blistering worse by forming thick, hydroxylated surface oxides which slowly decompose (about 325° C. for trihydroxides and about 525° C. for monohydroxide) upon heating. It has long been thought that such hydrogen diffusion into aluminum alloy articles and such has somehow been responsible for blistering and void formation in the heat-treated aluminum products. This can be particularly disadvantageous in some areas such as aerospace applications.

Figure 1:
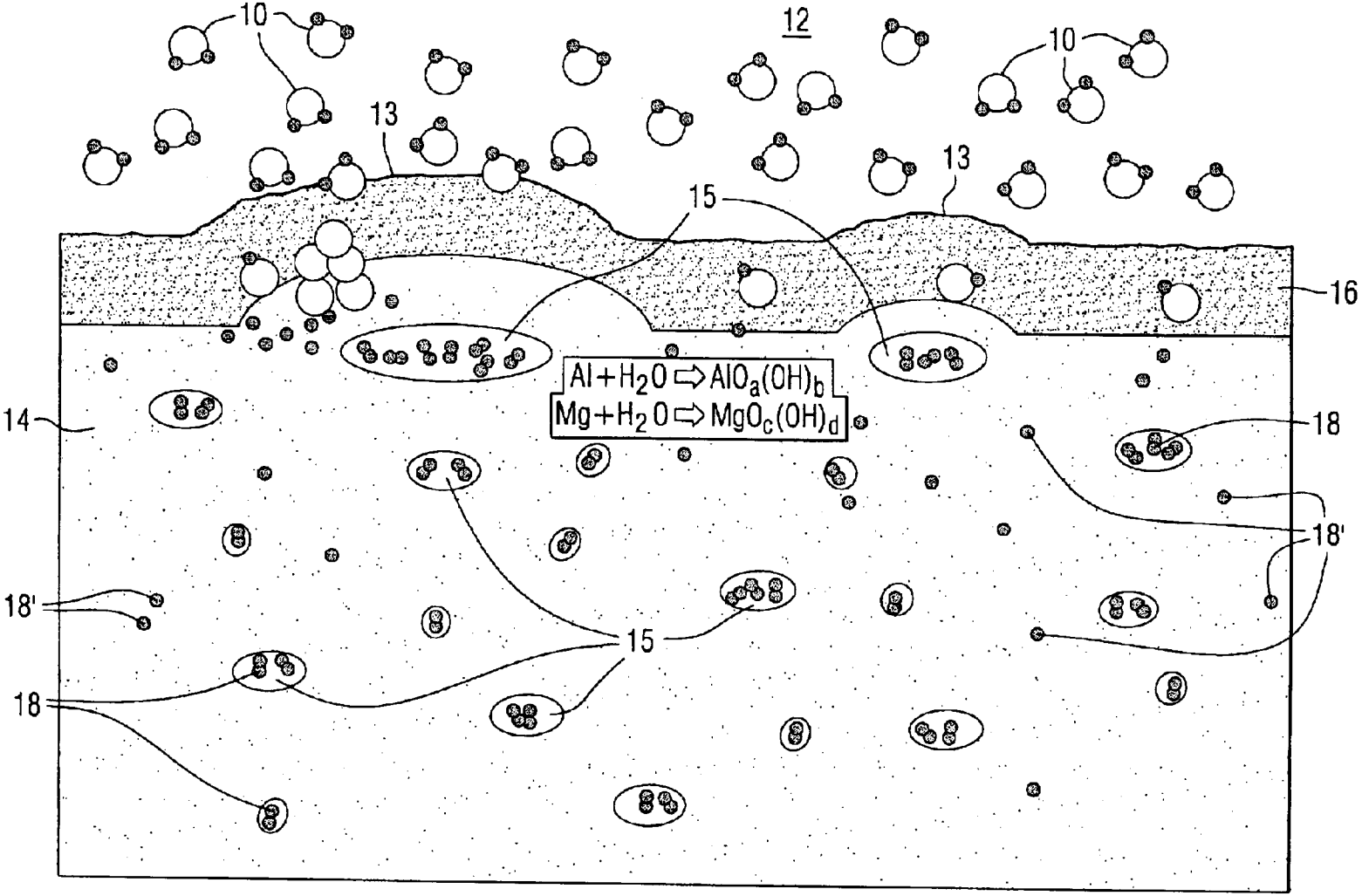
FIG. 1 shows an idealized schematic cross-section illustrating one possible mechanism causing hydrogen pickup, oxide growth, internal void formation, and surface blistering for aluminum alloys.

FIG. 1, while not to scale, illustrates one theory of such hydrogen diffusion. At heating over about 200° C., water molecules 10 in the furnace heating atmosphere 12 penetrate the aluminum alloy substrate 14, which may contain magnesium and other elements and dissociates to form an oxide/hydroxide top layer 16 of Mg.Al.F.O, and free hydrogen clusters 18 deep within the body of the substrate by the reaction $Al+H_2O \rightarrow AlO_a(OH)_b$ and $MgO_c(OH)_d$, where a and c have a range of from 1 to 3 and b and d have a range of from 0 to 3. Also shown are resultant surface blisters 13 and interior voids 15 filled with hydrogen gas 18. An attempt to degas the hydrogen clusters in moisture can cause more hydrogen infusion, voids and surface blistering. Also shown are penetrating atomic hydrogen 18' in solid solution.

Figure 2:
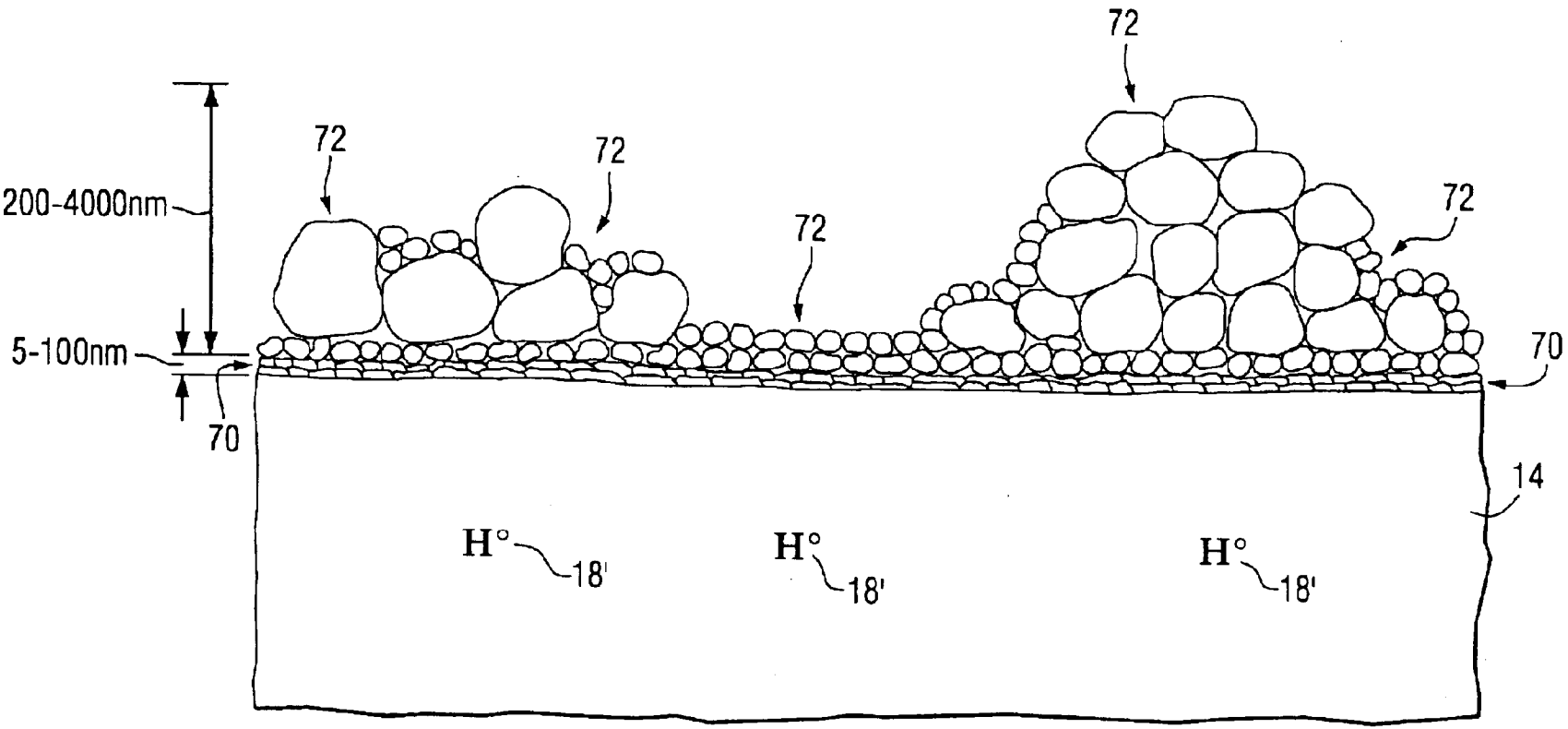
FIG. 2 shows an idealized, highly magnified cross section of an aluminum alloy object surface, showing contaminants such as oil, oxide scale and the like, before the treatment of this invention.

FIG. 2 illustrates an article such as aluminum alloy substrate 14 which has an initial oxide coating 70 which grows slowly at 25° C., and much faster over 400° C. On top of this is usually found residues of mixed dust, oil, or other organic or inorganic contaminants 72 which may reach heights of 200 nm to 4,000 nm, which prevent hydrogen 18' degassing and application of a uniform adherent protective coating. The surface oxide 70 and residue 72 can be completely removed to the extent that hydrogen from acid or base attack of the metal produces hydrogen bubbles showing evidence of aluminum metal attack, or until the oxide coating 70 is about 5 nm to 100 nm, and is uniform before coating. It is preferable not to remove and attack the aluminum but if this happens a new oxide will quickly (in seconds) form at 25° C., to about 2 nm to 50 nm.

Figure 3:
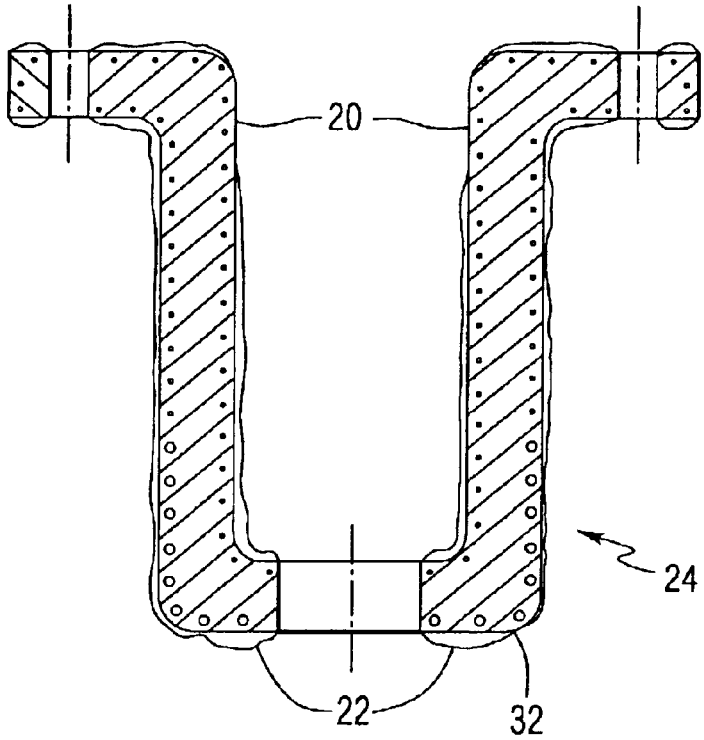
FIG. 3 PRIOR ART
FIG. 3, shows a complex shaped, aluminum alloy casting or machined article with a prior art aqueous coating of fluorine containing compound showing poor edge covering so that upon subsequent heat treatment a non-uniform protective film will usually result.

Prior art attempts to provide a protective coating usually dipped the substrate in an aqueous solution of sodium fluoroborate or the like, resulting, as shown in FIG. 3, in poor edge covering as at points 20 and non uniform coverage as at points 22, as for example on a complex shaped aluminum alloy casting 24. These protective coatings can be washed off by exposure of the treated article to snow, rain or condensing humidity, since the sodium fluoroborate or the like is soluble in water. Application from, for example a furnace vaporous atmosphere of aluminum fluoride usually resulted in similar non-uniform coating which upon cure were not totally protective of hydrogen infusion, particularly at areas where the aluminum article is in contact with solid supports, as at the bottom of a casting, forging, or wrought article.

Figure 4:
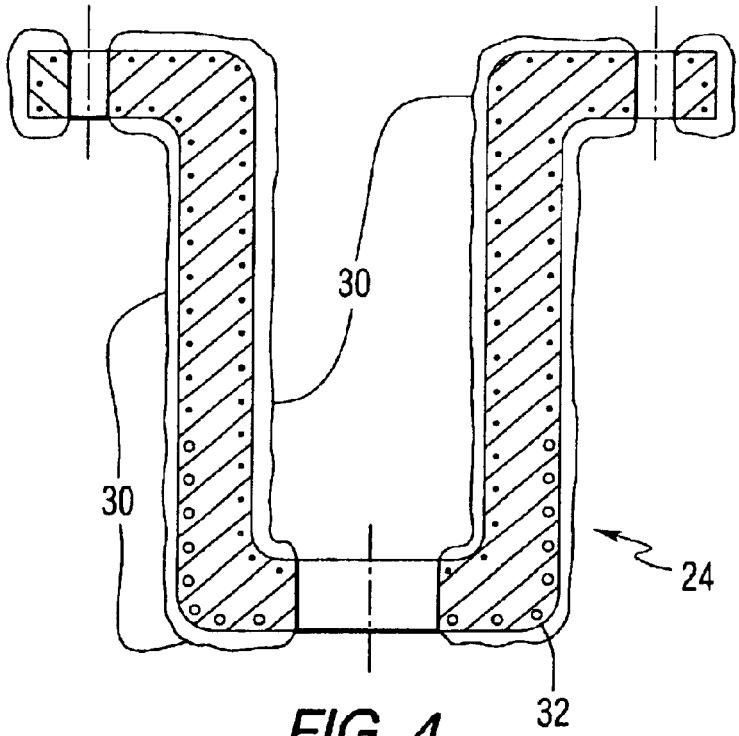
FIG. 4, shows the casting of FIG. 3 with the viscous paint coating of resin plus fluoride containing compound showing good edge covering so that upon subsequent heat treatment a generally uniform protective film will usually result.

In this invention, a viscous, paint-like, liquid coating of resin and fluoride is directly applied to a degreased, deoxidized surface, providing an antisagging, adherent coating 30 as shown in FIG. 4 with an essentially uniform surface, providing generally complete protection after curing, usually at room temperature (about 20° C. to 30° C.). There resin-fluoride coatings provide excellent coverage even at the compression/tension portions 32 of the casting. Once cured, the paint polymer coating is resistant to degradation by snow, rain, and condensing humidity.

Figure 5:
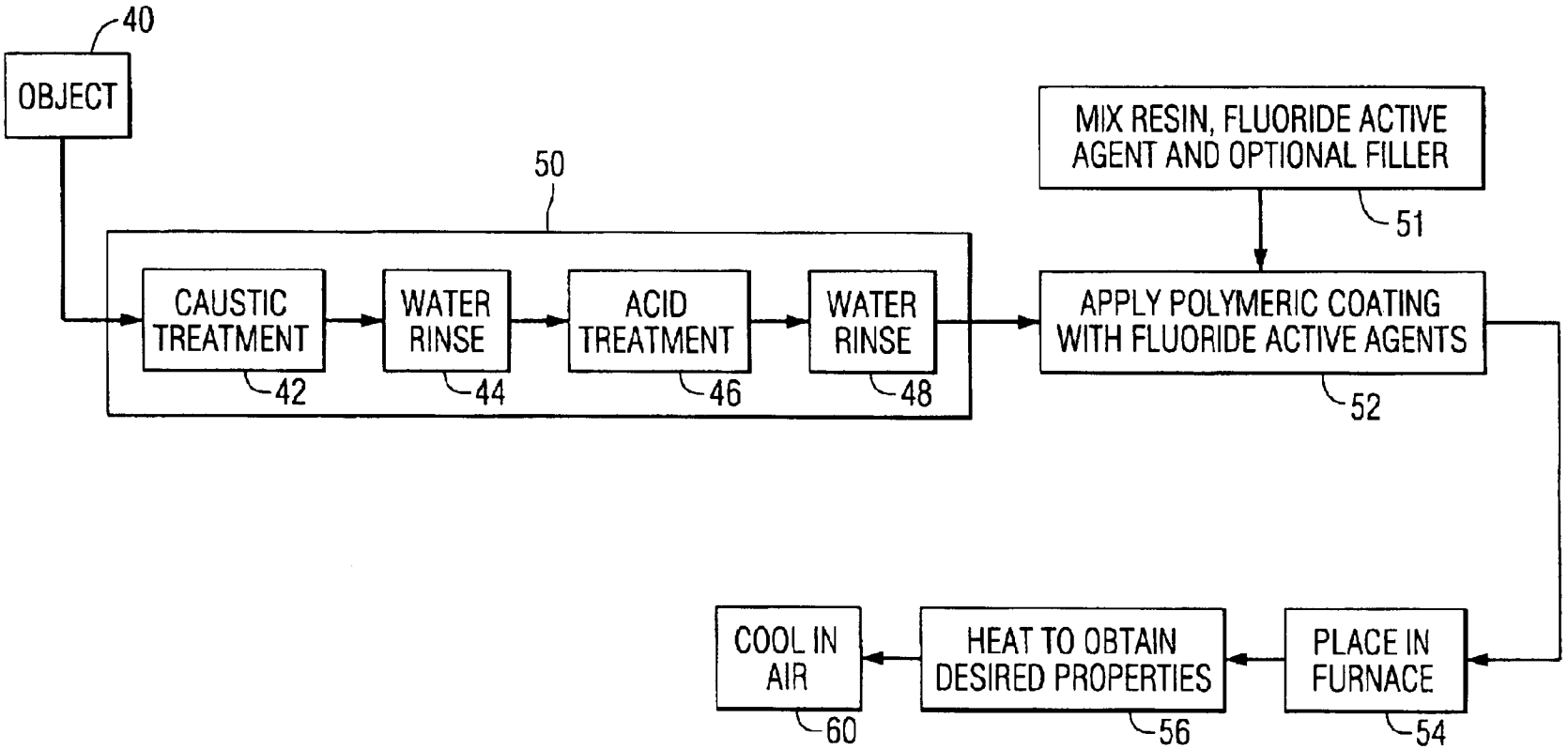
FIG. 5 shows a general block diagram of the method of this invention.

Referring now to FIG. 5, the process of this invention starts with a deoxidizing and cleaning of the aluminum alloy object/substrate. An object 40 to be coated, such as a machined part casting, forging or wrought article can optionally be degreased with a solvent such as organic solvents including hydrocarbon solvents (paraffins, cycloparaffins, olefins, aromatics, and terpene), halogenated hydrocarbons (chlorinated, fluorinated, brominated, and iodinated hydrocarbons), nitroparaffins, organic sulfur compounds (dimethyl sulfoxide, sulfolene, sulfolane), monohydric alcohols, polyhydric alcohols, aldehydes, ethers, glycol ethers, ketones, organic acids, amines, alkanol amines, glycol ether amines, nitriles, esters, and heterocyclic compounds that are gases or liquid at or near room temperature. Acetone, a ketone, or isopropanol, an alcohol, are inexpensive choices. The article is immersed in caustic 42 having a pH>8, such as a 5 wt. % NaOH at about 60° C. to 80° C., for 20 seconds to 40 seconds. It should be noted that the time frames set forth here are illustrative and may depend on the composition and thickness of the contaminant coating to be removed. It is then rinsed in water 44, preferably deionized water, for about 40 seconds to 80 seconds. It should not be allowed to dry (remains wet) before the rinse. This step is followed by immersion in acid 46 having a pH<6, for example 50 vol. % $HNO_3$ for about 10 seconds to 20 seconds. It is rinsed in water 48, preferably deionized water for about 40 seconds to 80 seconds to provide the deoxidizing and cleaning process 50.

After this process, little or no organics or oxides remain having a thickness over 100 nm (nanometer where 1 nanometer=$10^{-9}$ meters), preferably no more than 50 nm, most preferably 40 nm or lower. This is an essential and critical process. Without this process the effectiveness of the active fluoride agents for inhibiting hydrogen pickup and for promoting hydrogen degassing would be substantially lessened, with increased probability of void formation, blistering and reduced hydrogen outgassing upon final heat treating above 427° C. (801° F.). By use of this process starting articles having a water stain, that is greater than 15 nm or having thick thermal oxides can be protectively coated and natural oxides formed during casting removed. The thickness of any remaining organics or oxides can be determined by one of several surface analyses methods including but not limited to x-ray photoelectron spectrometry (XPS), Auger electron spectrometry (AES), ion scattering spectrometry (ISS), secondary ion mass spectrometry (SIMS), and infrared spectrometry, all of which are well known surface analyses methods. It is important that remaining organics or oxides over 100 nm be removed to form a homogeneous chemical layer toward forming fluoride over the entire exposed surface area.

Finally, the object/substrate can be blow dried, heated or otherwise dried and stored, preferably with oil free air prior to application of the polymeric coating in step 52 of FIG. 5. In step 51 the resin, such as epoxy, polyurethane, latex, polyacrylate and the like can be added to a mixing vessel with a stirrer. The fluorine containing compound is preferably selected from a group consisting of materials having the formula $A_xG_yF_z$, where x=1 to 5, y=0 to 5, and z=1 to 10, and polymers thereof, as shown in Table 1; A=metal or $NH_4$; G=H, B, Si, P, Al, or Zr; and F=fluorine. The fluorine containing compound may be anhydrous or hydrated with water. One or more fine filler materials can also be added, preferably in a variety of particle sizes, such as a fine powder having a particle size range of from 0.01 micrometer to 100 micrometers, preferably 0.1 micrometer to 50 micrometers. If the size is over about 100 micrometers, non-uniform particle distribution occurs, particles settle and excess material is used. The use of filler can also help to control viscosity. Useful fillers include $TiO_2$, $SiO_2$, $Al_2O_3$, SnO, MgO, $ZrO_2$, CaO, talc, ZnO and the like, and mixtures thereof The filler can also trap volatile reactive fluoride and keep it near the surface. With further heating, the fluoride can decompose providing increased protection.

The weight ratio of fluorine containing compound to resin (curable polymer) can range from 0.0001:1 to 2:1, preferably from 0.01:1 to 1:1. Under a 0.0001:1 weight ratio insufficient fluoride is available to protect the surface in a uniform manner. Over a 2:1 weight ratio excess fluoride can corrode the surface and/or be utilized to corrode furnace components, and provide excessive emissions.

Examples of some useful fluorine containing components are set out in Table 1 below:

TABLE 1

| Compound | Formula |
|---|---|
| Aluminum trifluoride | $AlF_3$ |
| Ammonium bifluoride | $NH_4HF_2$ |
| Ammonium fluoride | $NH_4F$ |
| Ammonium fluoroborate | $NH_4BF_4$ |
| Ammonium fluorophosphate | $NH_4PF_6$ |
| Ammonium hexafluorosilicate | $(NH_4)_2SiF_6$ |
| Calcium fluoride | $CaF_2$ |
| Calcium fluoroborate (anhyd) | $Ca(BF_4)_2$ |
| Magnesium fluoride | $MgF_2$ |
| Magnesium hexafluoride | $MgSiF_6$ |
| Potassium hexafluoroaluminate | $K_3AlF_6$ |
| Potassium hexafluorosilicate | $K_2SiF_6$ |
| Sodium Fluoride | NaF |
| Sodium hexafluoroaluminate | $Na_3AlF_6$ |
| Sodium hexafluorosilicate | $Na_2SiF_6$ |
| Sodium hydrogen fluoride | $NaHF_2$ |
| Sodium tetrafluoroborate | $NaBF_4$ |
| Tin (II) fluoride | $SnF_2$ |
| Zirconium (IV) fluoride | $ZrF_4$ |
| Ammonium zirconium fluoride | $(NH_4)_2ZrF_6$ |
| Potassium Fluoride | KF |
| Potassium Zirconium fluoride | $K_2ZrF_6$ |

Figure 6:
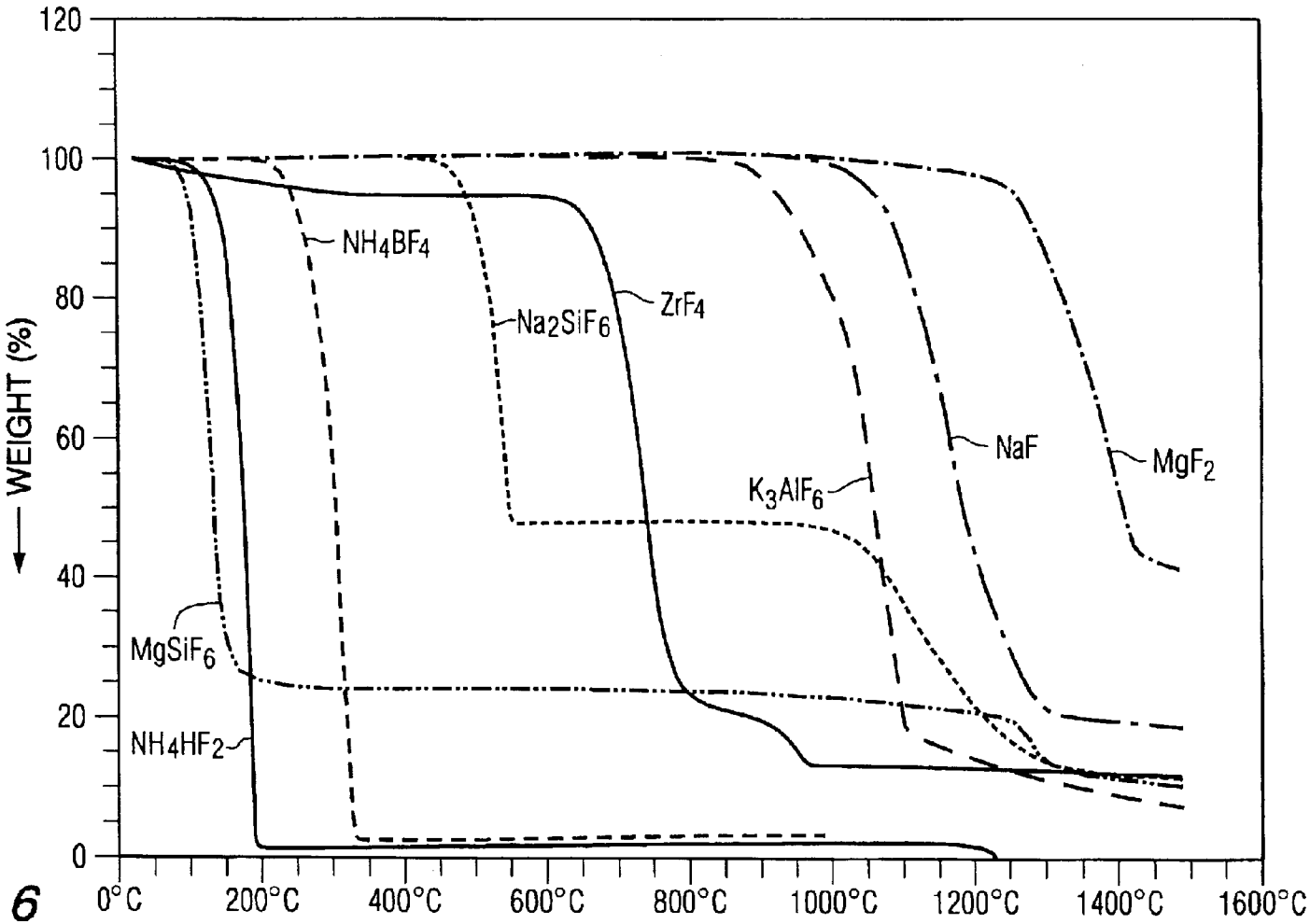
FIG. 6 is a graph showing a summary of thermogravimetric analysis of fluoride compounds that decompose in air at different temperatures showing decomposition temperatures in ° C. vs. percent weight with increasing sample temperature.

The preferred materials are those that would be cost effective and commercially available. By using mixtures of these materials, coatings with multiple decomposition temperatures can be achieved which is advantageous because it prolongs the presence of reactive fluoride on the surface of the aluminum article. This is particularly important for long soak times required for large articles. As shown in FIG. 6, which is a graph of the weight percent change of fluorine compound vs. temperature (° C.), where weight loss at a specific temperature indicates volatilization and decomposition of the fluoride compound. As can be seen, in FIG. 6, some fluoride compounds have a characteristic decomposition temperature while others can have more than one decomposition temperature, such as sodium hexafluorosilicate. It shall be noted that productive fluorides can be available well below the decomposition temperature, as for example, $MgF_2$, has an onset decomposition temperature>1100° C. but is an effective coating when the aluminum article is heated to 488° C. (910° F.). Others shown are $MgSiF_6$; $NH_4HF_2$; $NH_4BF_4$; $ZrF_4$; $K_3AlF_6$; and NaF.

The resin, fluorine containing compound, optional filler and a suitable solvent, such as water, mineral spirits, turpentine, acetone, 2-propanol and the like are stirred and mixed as by stirring between about 10° C. and 50° C. for from about 0.1 hr to 2 hr to provide a homogeneous mixture having a viscosity at 25° C. of from about 1.5 cP to 8,000,000 cP. Above 8,000,000 cP the material becomes so viscous that the coating cannot be applied to form a uniform thickness. Common examples of high viscosity fluids are putty and asphalt. Below 1.5 cP the fluid has significant sag and produces a nonuniform thickness over the aluminum article. The coating will not be like common solvents but a viscous liquid. Additionally the coating can be electrostatically applied without any solvent by well known technologies.

As shown in FIG. 5, in step 52, the liquid polymeric coating is applied to the surface of the object or article. Application can be by spraying, dipping, electro coating, and electrostatic spraying or the like. The preferred method of application is by dipping because the coating is applied equally to all surfaces, is fast, and requires low capital investment. The coating applied after the cleaning step will have from 50,000 to 20,000,000 fluorine atoms per square nanometer of the article's surface area. This can be easily calculated by using surrogate flat sheet samples with known area and weight increase after the coating is cured. Using a 100 $cm^2$ sheet of aluminum with a total area of 200 $cm^2$ (top and bottom surfaces), with a cured coating weight of 5.2 g (65 wt. % $Na_2SiF_6$ in the resin), the number of fluorine atoms applied per square nanometer is about 3,000,000.

Figure 7:
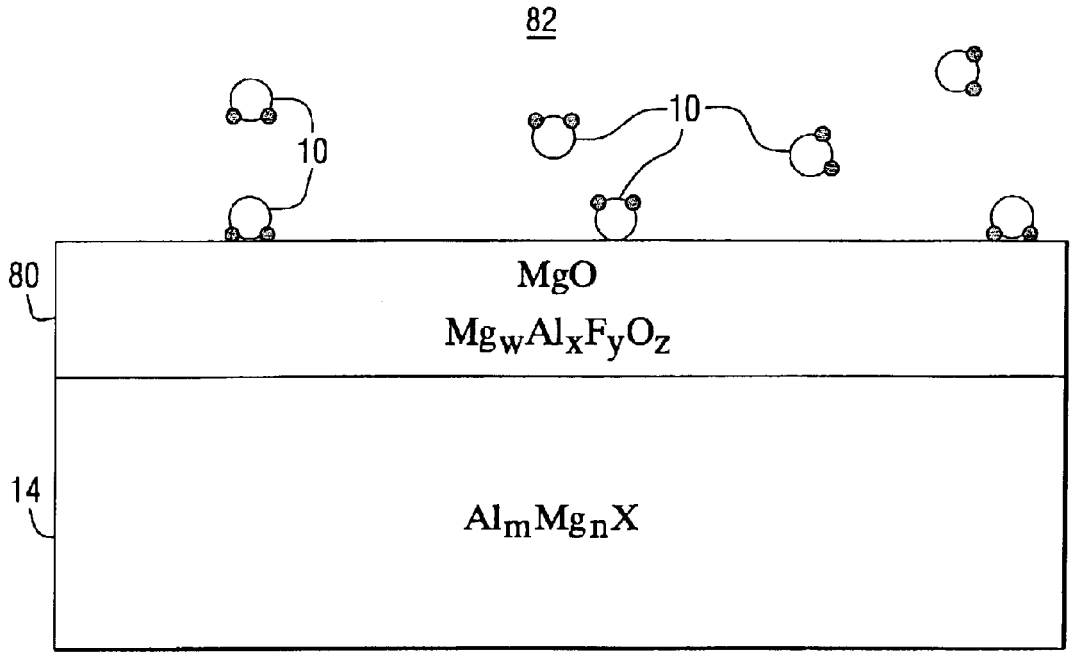
FIG. 7 shows an idealized schematic cross section illustration of an aluminum alloy substrate with the protective coating of the invention.

The polymeric coating thickness will generally be from about 0.01 mm to 3.0 mm, preferably from about 0.05 mm to 1.0 mm, to provide good edge coverage, as shown in FIG. 4. Over 3.0 mm excessive coating will be wasted. Under 0.01 mm insufficient active ingredient will be available. This coating will cure at ambient temperatures, just as a paint will and will contain the active fluorine compound(s) homogeneously dispersed in resin, providing upon cure, a protective coating from rain, snow or soiling. This coated object/article can then be safely stored indefinitely before furnace treatment in step 54 of FIG. 5. Preferably the process should yield a continuous coating layer over the article's entire coatable surface. The thermal process of steps 54 and 56 in FIG. 5, involve placing the coated object/article into a furnace and heating it through several stages from about 0° C. to between about 400° C. to 650° C. (752° F. to 1202° F.), in a continuous thermal process, to oxidize, vaporize and/or pyrolyze the resin, inhibit hydrogen pick-up within the article, degas hydrogen within the object/article and form a protective oxyfluoride film. At about 204° C. the heat dissipates, melts, or decomposes the resin solvent and any low stability fluorine compounds and leaves an active fluoride compound and any filler present. The resin decomposes primarily to $CO_2+H_2O$ if sufficient oxygen is present. Upon reaching about 400° C., or higher stability fluorine compounds are decomposed and become active thus promoting the release of hydrogen via degassing from the aluminum article. The resulting film is a protective oxyfluoride coating which will not allow infusion of water or hydrogen back into the article. A schematic drawing of the protected surface after step 56 in FIG. 5 is shown in FIG. 7. The protective oxyfluoride coating 80 on the aluminum alloy substrate 14 comprises Mg.Al.F.O, (such as $Mg_wAl_xF_yO_z$) and MgO, where w is from about 1 to 3; x is from about 0 to 3; y is from about 1 to 6 and z is from about 1 to 6. The protective coating 80 protects the aluminum article from water 10 in the atmosphere 82, from reaction infiltration/penetration because the thermal oxide formed is dense and thermodynamically stable (i.e., non-reactive with water molecules contacting the surface of the aluminum article). Evidence of this is that no thick, porous dark colored oxides are on the surface even when the aluminum article is heated to temperatures near the melting point, in high humidity. After the thermal process of steps 54 and 55 in FIG. 5, the protective film coated object/article can be cooled in ambient air in step 60.

EXAMPLES

Example 1

Three small cylinders of 2024 aluminum alloy were deoxidized according to the procedures 50 shown in FIG. 5.

The active ingredient, sodium hexafluorosilicate, was added to polyurethane (1 to 4 parts mineral spirits) to form a 65 wt. % sodium hexafluorosilicate solid mixture. The mixture was applied in two steps to achieve complete coverage to the cylinders of 2024 aluminum alloy using a paint brush. After curing, the three cylinders were placed into a quartz tube furnace. Air saturated with moisture to form a 95° F. DP (dew point) mixture was passed over the cylinders during heating to 910° F. The soak time at 910° F. was 2 hours. No surface blisters were observed for the coated samples.

After cooling to room temperature, the thermal oxide was removed by machining. The average bulk hydrogen value decreased from an initial value of 0.11 ppm $H_2$ to a value of 0.03 ppm $H_2$. This is a 72% reduction of bulk hydrogen and indicates hydrogen degassing. For an untreated sample, the bulk hydrogen value was 0.18 ppm $H_2$, a 63% increase.

Example 2

The same procedure was completed as in example 1, except that sodium hexafluoroaluminate was used. After the thermal treatment at 910° F. for 2 hours, the bulk hydrogen value decreased to a value 0.03 ppm $H_2$ from the initial value 0.11 ppm $H_2$. For an untreated sample, the bulk hydrogen value was 0.18 ppm. No surface blisters were observed for the coated samples.

Example 3

The same procedure was used as in Example 1, except that 7075 aluminum alloy was used instead of 2024 aluminum alloy. The initial bulk hydrogen value was 0.09 ppm $H_2$ and after the thermal treatment the value was reduced to 0.03 ppm $H_2$, a 67% reduction in bulk hydrogen.

While the invention has been described in terms of preferred embodiments, various changes, additions and modifications may be made without departing from the scope of the invention as set forth in the following claims.

What is claimed is:

1. A method for protecting a coatable surface of an aluminum alloy article, said article having a surface containing oxides and organic contaminants, comprising a. contacting at least one coatable surface of aluminum alloy article containing at least about 0.1 wt. % magnesium and interior diffused hydrogen with a caustic solution having a pH greater than 8, rinsing said coatable surface with water, contacting said coatable surface with an acid solution having a pH less than 6, and again rinsing said coatable surface with water, thereby to remove organics and oxide present on said coatable surface, such that any oxide layer remaining on the surface has a thickness of less than 100 nm;

b. while the oxide layer thickness remains less than 100 nm, applying to said coatable surface a coating comprising an organic resin and a fluorine compound so that the coatable surface is covered by at least about 50,000 fluorine atoms per square nm; and c. heating the coated article to a temperature above about 400° C. to allow hydrogen degassing and to decompose said organic resin and at least a portion of said fluorine compound.

2. The method of claim 1 wherein said article comprises an aluminum alloy of the AA2000, 3000, 4000, 5000, 6000, or 7000 series.

3. The method of claim 1 wherein said article comprises an aluminum alloy billet, casting, forging, plate, sheet, or extrusion.

4. The method of claim 1 wherein said coatable surface is not allowed to dry after said contacting with the caustic solution or after said contacting with the acid solution.

5. The method of claim 1 wherein said oxide layer of step (a) has a thickness of less than about 50 nm and the coating of step (b) is applied while the oxide layer thickness remains less than about 50 nm.

6. The method of claim 1 wherein said coating has a viscosity of from 1.5 cP to 8,000,000 cP, and the heating in step (c) is from about 0° C. to 650° C. in a continuous thermal process to oxidize and/or pyrolyze the resin, inhibit hydrogen pickup and degas hydrogen within the article and leave an active fluorine compound, and the article is a heat treated article.

7. The method of claim 1 wherein said coating comprises an organic resin selected from the group consisting of epoxies, polyurethanes, latex resins, polyacrylates, polyolefins, and mixtures thereof.

8. The method of claim 1 wherein said organic resin is water-insoluble.

9. The method of claim 1 wherein said fluorine compound is a fluoride of a metal or ammonium.

10. The method of claim 1 wherein said fluorine compounds is selected from anhydrous and hydrated compounds having the formula $A_xG_yF_z$ wherein x=1–5, y=0–5, z=1–10, A is a metal or $NH_4$, G is H, B, Si, P, Al, or Zr, and F is fluorine.

11. The method of claim 1 wherein said fluorine compound is selected from the group consisting of sodium hexafluorosilicate, potassium aluminum fluoride, cryolite, potassium fluoride, sodium fluoride, magnesium fluoride, calcium fluoride, and mixtures thereof.

12. The method of claim 1 wherein said coating further comprises filler particles.

13. The method of claim 1 wherein the coating has a fluorine compound:organic resin weight ratio of about 0.0001 to 2.

14. The method of claim 1 wherein said coatable surface includes edge portions, and the coating applied in step (b) covers an entire coatable surface of said article including said edge portions.

15. The method of claim 1 wherein the aluminum alloy article contains interior diffused free hydrogen clusters, and wherein step (C) comprises heating the coated article at about 400–650° C. without surface blister formation.

16. The method of claim 1 wherein step (c) produces a uniform Mg.Al.F.O protective film on said coated surface with complete edge coverage.

17. The method of claim 15 wherein said protective film prevents blistering and hydrogen pickup and promotes further hydrogen degassing.

18. The method of claim 1 wherein the aluminum alloy article contains interior diffused hydrogen and where step (c) comprises heating the coated article to at least about 400° C., thereby to degas hydrogen from the article and to form a protective oxyfluoride film on said coatable surface.

19. An aluminum alloy article comprising a billet, casting, forging, plate, sheet, or extrusion, and further comprising an alloy of the AA2000, 3000, 4000, 5000, 6000, or 7000 series containing at least about 0.1 wt % magnesium, said article having at least one coatable surface provided with a Mg.Al.F.O protective film in accordance with the method of claim 1.

* * * * *